US006805432B1

(12) United States Patent
Milligan et al.

(10) Patent No.: US 6,805,432 B1
(45) Date of Patent: Oct. 19, 2004

(54) FLUID EJECTING DEVICE WITH FLUID FEED SLOT

(75) Inventors: Donald J Milligan, Corvallis, OR (US); Timothy L. Weber, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/919,699

(22) Filed: Jul. 31, 2001

(51) Int. Cl.[7] ..... B41J 2/05
(52) U.S. Cl. ..... 347/65; 347/63; 347/59
(58) Field of Search ..... 347/20, 65, 63, 347/54, 47, 59; 216/27

(56) References Cited

U.S. PATENT DOCUMENTS

| | | | | |
|---|---|---|---|---|
| 4,808,260 A | | 2/1989 | Sickafus et al. | 156/644 |
| 5,498,312 A | | 3/1996 | Laermer et al. | 428/161 |
| 5,501,893 A | | 3/1996 | Laermer et al. | 428/161 |
| 5,608,436 A | | 3/1997 | Baughman et al. | 347/65 |
| 5,658,471 A | * | 8/1997 | Murthy et al. | 216/27 |
| 5,867,192 A | * | 2/1999 | Mantell et al. | 347/65 |
| 6,143,190 A | * | 11/2000 | Yagi et al. | 216/27 |
| 2002/0118253 A1 | | 8/2002 | Ohno et al. | 347/47 |

FOREIGN PATENT DOCUMENTS

EP 430593 A2 6/1991

* cited by examiner

*Primary Examiner*—Hai Pham
*Assistant Examiner*—Lam Nguyen

(57) ABSTRACT

A method of forming a fluid ejecting device such as an ink jet printing device that includes forming a plurality of fluid drop generators on a first surface of a silicon substrate, forming a partial fluid feed slot in the silicon substrate by deep reactive ion etching, and forming a fluid feed slot by wet etching the partial fluid feed slot.

18 Claims, 2 Drawing Sheets

FLUID EJECTING DEVICE WITH FLUID FEED SLOT

BACKGROUND OF THE INVENTION

The disclosed invention relates generally to fluid ejecting devices such as ink jet printing devices, and more particularly to a fluid ejecting device having a narrow fluid feed channel.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to or integral with an ink barrier layer that in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. In an ink jet printhead of a slot feed design, ink is fed from one or more ink reservoirs, either on-board the print carriage or external to the print carriage, to the various ink chambers through one or more ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. Nos. 4,719,477 and 5,317,346, both of which are incorporated herein by reference.

A consideration with slotted printheads is the need for relatively narrow ink feed slots so that more ink feed slots can be placed in a given substrate area.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
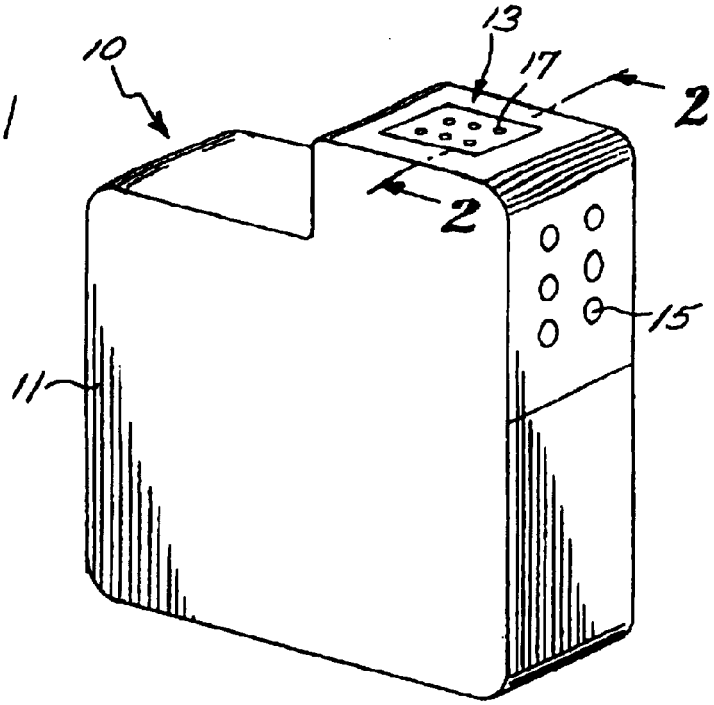
FIG. 1 is schematic perspective view of a print cartridge that can incorporate an embodiment of an ink jet printhead in accordance with the invention.

In the following detailed description and in the several figures of the drawing, like elements are identified with like reference numerals.

FIG. 1 is a schematic perspective view of one type of ink jet print cartridge 10 that can incorporate fluid ejecting printhead structures in accordance with the invention. The print cartridge 10 includes a cartridge body 11, a printhead 13, and electrical contacts 15. The cartridge body 11 contains ink that is supplied to the printhead 13, and electrical signals are provided to the contacts 15 to individually energize ink drop generators to eject a drop let of ink from a selected nozzle 17. The print cartridge 10 can be a disposable type that contains a substantial quantity of ink within its body 11, but another suitable print cartridge may be of the type that receives ink from an external ink supply that is mounted on the print cartridge or connected to the print cartridge via a tube.

Figure 2:
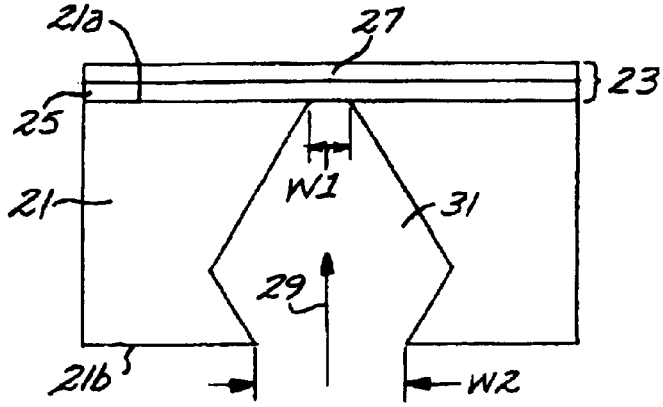
FIG. 2 is a schematic transverse cross-sectional view of an embodiment of a printhead in accordance with the invention.
Figure 3:
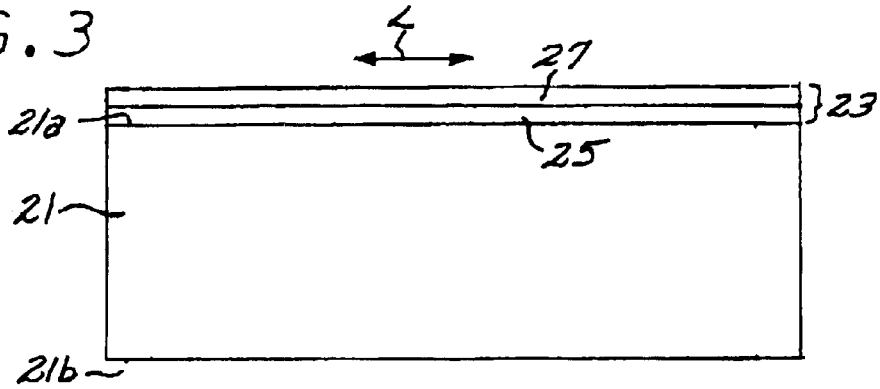
FIG. 3 is a schematic side elevational view of the printhead of FIG. 2.

Referring to FIGS. 2 and 3, the printhead 13 includes a silicon substrate 21 and a drop generator substructure 23 formed on a front surface 21*a* of the silicon substrate 21. The drop generator substructure 23 implements for example thermal ink drop generators wherein an ink drop generator is formed of a heater resistor, an ink firing chamber, and a nozzle. By way of illustrative example, the printhead 13 has a longitudinal extent along a longitudinal reference axis L and the nozzles 17 can be arranged in columnar arrays aligned with the reference axis L.

The drop generator substructure 23 can more particularly include a thin film stack 25 that implements ink firing heater resistors and associated electrical circuitry such as drive circuits and addressing circuits. The thin film stack 25 can be made pursuant to integrated circuit thin film techniques. Disposed on the thin film stack 25 is an orifice layer 27 that embodies ink firing chambers, ink channels, and the nozzles 17. The orifice layer 27 can be made of a photodefinable spun-on epoxy called SU8.

Ink 29 is conveyed from a reservoir in the cartridge body 11 to the ink drop generator substructure 23 by an elongated ink feed slot 31 formed in the silicon substrate 21. The ink feed slot 31 extends along the longitudinal axis L of the printhead, and ink drop generators can be disposed on one or both sides of the elongated ink feed slot 31. The ink feed slot 31 further extends from a back surface 21*b* of the silicon substrate 21 to the front surface 21*a* of the silicon substrate 21, and thus includes an opening in the top surface 21*a* and an opening in the back surface 21*b*. By way of illustrative example, the width W1 of the front surface opening of the ink feed slot 31, as measured transversely to the longitudinal extent of the ink feed slot, can be about one-third of the width W2 of back surface opening of the ink feed slot 31. By way of specific examples, the width W1 can be about 100 micrometers or less, and the width W2 can be about 300 micrometers or less.

The printhead structure can be made generally as follows.

Figure 4:
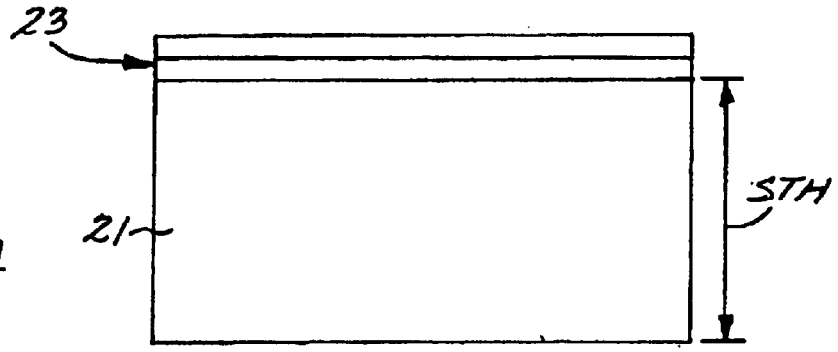
FIGS. 4, 5, 6, and 7 are schematic transverse cross-sectional views illustrating various stages in the manufacture of the printhead of FIGS. 2 and 3.

In FIG. 4, an ink drop generator substructure 23 is formed on the front side of a silicon substrate 21 having a thickness STH and a crystalline orientation of <100>. The ink drop generator substructure 23 can formed, for example, by thin film integrated circuit processes, and photodefining and etching techniques.

Figure 5:
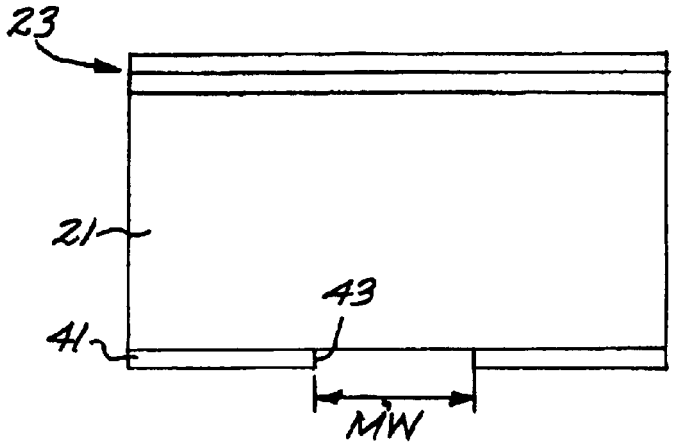

In FIG. 5, the back side of the silicon substrate 21 is masked by mask 41 to expose the portion of the back side of the silicon substrate to be subjected to subsequent etching. The backside mask 41 may be a FOX hardmask formed using conventional photolithographic and etch techniques. The mask 41 has an ink feed slot opening 43 having a width MW that corresponds to the desired back side width of the ink feed slot to be formed. The longitudinal extent of the ink feed slot opening is aligned with the <100> plane of the substrate. The width MW of the mask opening 43 can be selected on the basis of the following relationship which assumes a vertical dry etch profile (i.e., substantially no re-entrancy) and substantially 100 percent anisotropic wet etch.

$$W2 \cong \tan(54.7°)*(STH-DD)+W1$$

W2 is the back side ink feed slot width, 54.7° is the angle between the <100>plane and the <111> plane, STH is the thickness of the silicon substrate, DD is the depth of the dry etch, and W1 is the front side ink feed slot width. For example, the width W2 and the dry etch depth can be selected to achieve a desired front side slot width W1. It should be noted that in practice the front side ink feed slot width W1 can be made greater than what would be predicted by the foregoing since there will be some re-entrant etching in the dry etch, whereby the etched walls will diverge very slightly from vertical. The amount of re-entrancy increases with etch rate, and can allow for a narrower back side ink feed slot width W2 for a selected front side slot width W1.

The relationship between the front side slot width W1 and the back side slot width W2 with re-entrant dry etching can be expressed as follows wherein α is the angle of re-entrancy.

$$W1 \cong W2+2[DD*\tan\alpha+(DD-STH/\tan(54.7°))]$$

Figure 6:
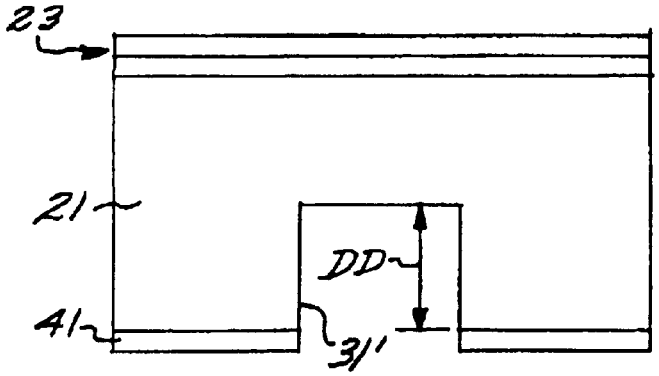

In FIG. 6, the back side masked silicon substrate 21 is subjected to an anisotropic deep reactive ion etch (DRIE) to form a partial ink feed slot 31' to a dry etch depth DD that can be selected on the basis of a selected width W1 and a selected back side slot width W2, for example. By way of illustrative example, the deep reactive ion etching is accomplished using a polymer deposition dry etch process.

Figure 7:
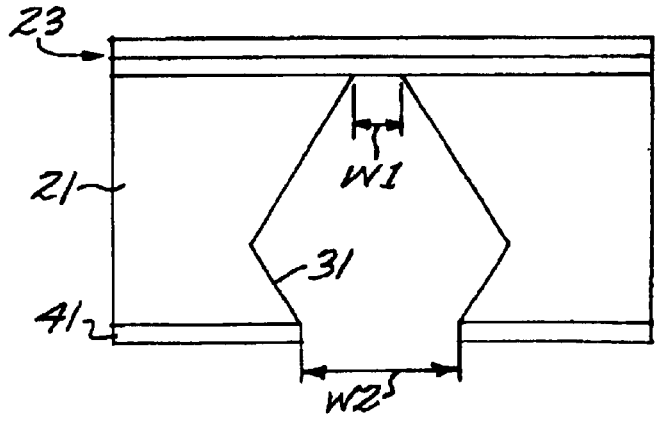

In FIG. 7, the silicon substrate 21 is subjected to a TMAH (tetramethyl ammonium hydroxide) or similar wet etch (e.g., KOH) to etch the partial ink feed slot to complete formation of the ink feed slot 31.

By way of illustrative example, an ink feed slot having a back side width of 300 micrometers, a front side width of 100 micrometers can be formed in a silicon substrate having a thickness of about 675 micrometers by dry etching to a depth of about 475 micrometers and with a re-entrancy of about 5 degrees, and then TMAH etching for about 5.5 hours. More generally, the depth of dry etching can be at least one-half the thickness of the silicon substrate.

The structure of FIG. 7 is then processed appropriately, for example to open ink holes and/or channels in the thin film stack and to remove the backside mask 41.

The foregoing has thus been a disclosure of a fluid droplet generating device that is useful in ink jet printing as well as other droplet emitting applications such as medical devices, and techniques for making such fluid droplet generating device.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid ejecting device comprising:

a silicon substrate having a <100> crystalline orientation;

a plurality of fluid drop generators formed on a first surface of said silicon substrate;

a fluid feed slot extending from a second surface of said silicon substrate to said first surface;

said fluid slot formed by deep reactive ion etching from the second surface of said silicon substrate to a depth of at least one-half a thickness of the silicon substrate followed by anisotropic wet etching, and having an opening at the first surface having a width W1 that is less than a width W2 of an opening at the second surface.

2. A fluid ejection device comprising:

a silicon substrate having a <100> crystalline orientation;

a plurality of fluid drop generators formed on a first surface of said silicon substrate;

a fluid feed slot extending from a second surface of said silicon substrate to said first surface;

said fluid slot formed by deep reactive ion etching from the second surface of said silicon substrate followed by anisotropic wet etching, and having an opening at the first surface having a width W1 that is less than a width W2 of an opening at the second surface, wherein said fluid feed slot was formed by deep reactive ion etching to a depth of at least one-half of a thickness of the substrate.

3. A fluid ejecting device comprising:

a silicon substrate having a <100> crystalline orientation;

a plurality of fluid drop generators formed on a first surface of said silicon substrate;

a fluid feed slot extending from a second surface of said silicon substrate to said first surface;

said fluid slot formed by deep reactive ion etching followed by anisotropic wet etching, and having an opening at the first surface having a width W1 that is less than a width W2 of an opening at the second surface, wherein said fluid feed slot was formed by deep reactive ion etching to a depth of at least about 475 micrometers.

4. A fluid ejection device comprising:

a silicon substrate having a <100> crystalline orientation;

a plurality of fluid drop generators formed on a first surface of said silicon substrate;

a fluid feed slot extending from a second surface of said silicon substrate to said first surface;

said fluid slot formed by deep reactive ion etching from the second surface of said silicon substrate followed by anisotropic wet etching, and having an opening at the first surface having a width W1 that is less than a width W2 of an opening at the second surface, wherein the substrate has a thickness of about 675 micrometers or less; and wherein said fluid feed slot was formed by deep reactive ion etching to a depth of at least one-half of a thickness of the substrate.

5. The fluid ejecting device of claim 4 wherein:

W1 is about 100 micrometers; and

W2 is about 300 micrometers.

6. A fluid ejecting device comprising:

a silicon substrate <100> crystalline orientation;

a plurality of fluid drop generators formed on a first surface of said silicon substrate;

a fluid feed slot extending from a second surface of said silicon substrate to said first surface;

said fluid slot formed by deep reactive ion etching followed by anisotropic wet etching, and having an opening at the first surface having a width W1 that is less than a width W2 of an opening at the second surface, wherein the substrate has a thickness of about 675 micrometers or less; and wherein said fluid feed slot was formed by deep reactive ion etching to a depth of at least about 475 micrometers.

7. A fluid ejecting device comprising:

a silicon substrate having a <100> crystalline orientation;

a plurality of fluid drop generators formed on a first surface of said silicon substrate;

a fluid feed slot extending from a second surface of said silicon substrate to said first surface;

said fluid slot formed by deep reactive ion etching followed by anisotropic wet etching, and having an opening at the first surface having a width W1 that is less than a width W2 of an opening at the second surface, wherein the substrate has a thickness STH;

said fluid feed slot was formed by deep reactive ion etching to a depth DD, with an angle of re-entrancy $\alpha$; and

W1 equals about W2+2(DD*tan $\alpha$+(DD−STH/tan(54.7 deg.))).

8. The fluid ejecting device of claim 7 wherein said fluid feed slot was formed by deep reactive ion etching to a depth of at least one-half of a thickness of the substrate.

9. The fluid ejecting device of claim 7 wherein W1 is about 100 micrometers or less.

10. The fluid ejecting device of claim 7 wherein W2 is about 300 micrometers or less.

11. The fluid ejecting device of claim 7 wherein:

W1 is about 100 micrometers or less; and

W2 is about 300 micrometers or less.

12. The fluid ejecting device of claim 7 wherein said angle of re-entrancy $\alpha$ is about 5 deg.

13. A fluid ejecting device comprising:

a silicon substrate having a <100> crystalline orientation and a thickness STH;

a plurality of fluid drop generators formed on a first surface of said silicon substrate;

a fluid feed slot extending from a second surface of said silicon substrate to said first surface;

said fluid slot being formed at least in part by deep reactive ion etching to a depth DD, with an angle of re-entrancy $\alpha$, and having an opening at the first surface having a width W1 that is less than a width W2 of an opening at the second surface, wherein W1 equals about W2+2(DD*tan $\alpha$+(DD−STH/tan(54.7 deg.))).

14. The fluid ejecting device of claim 13 wherein said angle of re-entrancy $\alpha$ is about 5 deg.

15. The fluid ejecting device of claim 13, wherein DD is more than one half of STH.

16. The fluid ejecting device of claim 13 wherein W1 is about 100 micrometers or less.

17. The fluid ejecting device of claim 13 wherein W2 is about 300 micrometers or less.

18. The fluid ejecting device of claim 13 wherein W1 is about 100 micrometers or less and W2 is about 300 micrometers or less.

* * * * *